US006431207B1

(12) United States Patent
Weiler, Jr.

(10) Patent No.: US 6,431,207 B1
(45) Date of Patent: Aug. 13, 2002

(54) HIGH-PRESSURE BALL-POPPET CONTROL VALVE

(75) Inventor: Charles A. Weiler, Jr., Holly, MI (US)

(73) Assignee: Ross Operating Valve Company, Troy, MI (US)

( * ) Notice: Subject to any disclaimer, the term of this patent is extended or adjusted under 35 U.S.C. 154(b) by 0 days.

(21) Appl. No.: 09/527,395

(22) Filed: Mar. 16, 2000

(51) Int. Cl.[7] ..... F15B 13/043

(52) U.S. Cl. ..... 137/596.17; 91/454; 91/464; 137/596.16; 137/596.18; 137/884; 137/901; 251/61.3; 251/86; 251/333; 251/368

(58) Field of Search ..... 137/596.16, 596.17, 137/596.18, 901, 596.1, 596.14, 884; 251/84, 86, 88, 333, 61.3, 368; 91/454, 464

(56) References Cited

U.S. PATENT DOCUMENTS

| | | | | |
|---|---|---|---|---|
| 2,503,827 A | | 4/1950 | Langmore et al. | |
| 3,884,266 A | | 5/1975 | Kondo | |
| 3,934,610 A | | 1/1976 | Solie | |
| 4,067,357 A | | 1/1978 | Ruchser | |
| 4,111,226 A | | 9/1978 | Cameron | |
| 4,754,693 A | | 7/1988 | Teltscher | |
| 4,883,091 A | | 11/1989 | Weiler et al. | |
| 5,104,091 A | * | 4/1992 | Rathay et al. | 137/901 |
| 5,113,907 A | | 5/1992 | Russell | |
| 5,454,399 A | * | 10/1995 | Kazakis et al. | 137/596.18 |
| 5,567,023 A | | 10/1996 | Yoo | |
| 5,738,142 A | * | 4/1998 | Eike et al. | 137/596.17 |
| 5,915,416 A | * | 6/1999 | Okazaki et al. | 137/596.16 |
| 5,918,631 A | | 7/1999 | Weiler, Jr. et al. | 137/596.18 |

FOREIGN PATENT DOCUMENTS

| | | | |
|---|---|---|---|
| GB | 2076182 | * 11/1981 | 137/596.18 |

* cited by examiner

*Primary Examiner*—George L. Walton
(74) *Attorney, Agent, or Firm*—Harness, Dickey & Pierce, P.L.C.

(57) ABSTRACT

A high-pressure fluid control valve is disclosed for operating a fluid-actuated device. Preferably a ball-poppet and frusto-conical valve seat adapted for substantially line-type contact therebetween are provided with an upstream restricted flow area in order to substantially minimize sonic flow damage to the actual sealing surface of the valve seat. Preferably, the ball-poppet is movable within a poppet guide that is allowed to float radially in order to allow the ball-poppet to be substantially self-centering with respect to the valve seat. In addition, cross-over leakage is preferably negated by closing an exhaust ball-poppet just prior to opening a supply ball-poppet.

55 Claims, 5 Drawing Sheets

HIGH-PRESSURE BALL-POPPET CONTROL VALVE

BACKGROUND AND SUMMARY OF THE INVENTION

The invention relates generally to fluid control valves for operating a fluid-actuating device and more particularly to those valves employing one or more ball-poppets. Although the principles of the invention are applicable to both pneumatic and liquid fluid control valves, it is especially applicable to high-pressure pneumatic control valves.

A variety of fluid control valves, especially those of the pneumatic nature, have been provided for numerous different high-pressure applications, including those used in processes for blow-molding plastic bottles or other such containers. Although such control valves have generally functioned satisfactorily for the processes to which they have been applied, they have been found to be subject to excessive wear due to the high working fluid pressures involved and thus have had a relatively short life span. In addition, also in part due to the high pressures of the actuating fluids, such previously-provided fluid control valves have been subject to an unacceptable level of internal working fluid leakage, such as cross-over leakage that occurs when opening a supply portion of the valve and closing an exhaust portion of the valve in order to admit working fluid to the fluid-actuating device. As a result, both of these factors have contributed to the high operation costs and high maintenance costs of the systems in which the previously-provided fluid control valves have been used.

Therefore, the present invention seeks to provide an improved high-pressure fluid control valve that is significantly less subject to wear and that substantially negates internal working fluid leakage, thus contributing to the long life of the fluid control valve and reducing both operating and maintenance costs.

In accordance with the present invention, a control valve for operating a fluid-actuated device has an inlet in communication with a source of pressurized working fluid, an outlet in fluid communication with the fluid-actuated device, and a fluid supply passage providing fluid communication for the working fluid from the inlet to the outlet. The control valve preferably includes a generally frusto-conical supply valve seat in the fluid supply passage with the supply valve seat having a smaller-diameter downstream end and a larger-diameter upstream end. A generally spherical supply poppet is selectively movable between respective supply closed and supply open positions, into and out of a substantially line-contact for sealing with the smaller-diameter end of the supply valve seat. The spherical supply poppet has a chord dimension at such line-contact with the smaller diameter downstream end of the valve seat that is smaller than the larger-diameter upstream end of the supply valve seat.

The preferred frusto-conical supply valve seat has a supply seat angle relative to the centerline of the supply valve seat that is greater than an angle formed by the centerline of the supply valve seat and a line tangent to the supply poppet at the above-mentioned substantially line-contact when the supply poppet is in its closed position. This results in a annular space being formed between the supply valve seat and the spherical supply poppet, which defines a restricted supply flow area upstream of the above-mentioned substantially line-contact as the supply poppet initially moves to its open position and as high-velocity and high-pressure working fluid initially flows downstream past the supply poppet through the smaller-diameter end of the valve seat. This is greatly advantageous because any sonic flow erosion caused by the initial flow of the high velocity and high-pressure working fluid through the annular restricted supply flow area is thus shifted substantially immediately to an upstream surface of the supply valve seat that is adjacent to such annular restricted supply flow area. Most significantly, such upstream surface of the supply valve seat is an area that is not sealingly contacted by the supply poppet. Therefore, this immediate shifting of the sonic damage-susceptible area substantially minimizes sonic erosion of the nearly "knife-edge" smaller-diameter downstream end of the supply valve seat that is substantially line-contacted by the supply poppet. In control valves according to the present invention that have both supply valving and exhaust valving, a similar arrangement is preferably provided in the exhaust passage way in fluid communication for exhaust fluid between the load outlet and the exhaust outlet.

In addition, the present invention preferably includes a generally cylindrical cavity immediately upstream of the larger-diameter upstream ends of the supply and/or exhaust valve seats, with such cavity preferably being larger in diameter than the larger-diameter upstream end of the respective valve seats. A cylindrical poppet guide is located in this enlarged-diameter cavity of the fluid passageway, with the poppet guide having a central guide bore extending axially therethrough. A number of circumfcrentially spaced-apart axially-extending guide fins protrude radially inwardly into the guide bore, with the poppet being received within the guide bore for axial movement within radially inward edges of the guide fins between its open and closed positions. The inner diameter of the above-mentioned cavity is preferably slightly greater than the outer diameter of the poppet guide in order to allow the poppet guide and the poppet to float radially somewhat within the cavity. This allows the generally spherical poppet to be substantially self-centering for sealing line-contact with the smaller-diameter end of the respective supply or exhaust valve seat. Such circumferentially spaced guide fins allow high pressure working fluid to flow therebetween, and the poppet guide substantially minimizes wear on the ball-poppet and/or the valve seat that would result if it were to be allowed to rattle or otherwise move radially in the high-velocity fluid flow.

Finally, the present invention substantially negates cross-over leakage in high-pressure fluid control valves having both supply and exhaust valving by energizing the exhaust poppet actuator, thus closing the exhaust side of the control valve, just prior to energizing the supply poppet actuator, which then opens the supply side and initiates supply flow to the load port.

The above-mentioned ball-poppets are preferably composed of a metallic material, such as a stainless steel, for example, and the above-mentioned poppet guides are preferably composed of a synthetic material, such as nylon, for example. Those skilled in the art will readily recognize that other metallic, synthetic, or non-synthetic materials can also be employed for the ball poppets and/or the poppet guides, depending upon the particular working fluid (pneumatic or liquid) being employed, as well as the particular working fluid pressures involved, as well as depending upon the particular application in which the fluid control valve of the present invention is employed.

Additional objects, advantages, and features of the present invention will become apparent from the following description and the appended claims, taken in conjunction with the accompanying drawings.

DETAILED DESCRIPTION OF THE PREFERRED EMBODIMENTS

FIGS. 1 through 9 illustrate an exemplary high-pressure pneumatic control valve 10 in accordance with the present invention. Although the drawings depict such exemplary pneumatic fluid control valve, one skilled in the art will readily recognize that the principles of the present invention are equally applicable to other types of fluid control valves, as well as to fluid control valves for either pneumatic or liquid working fluids.

Figure 1:
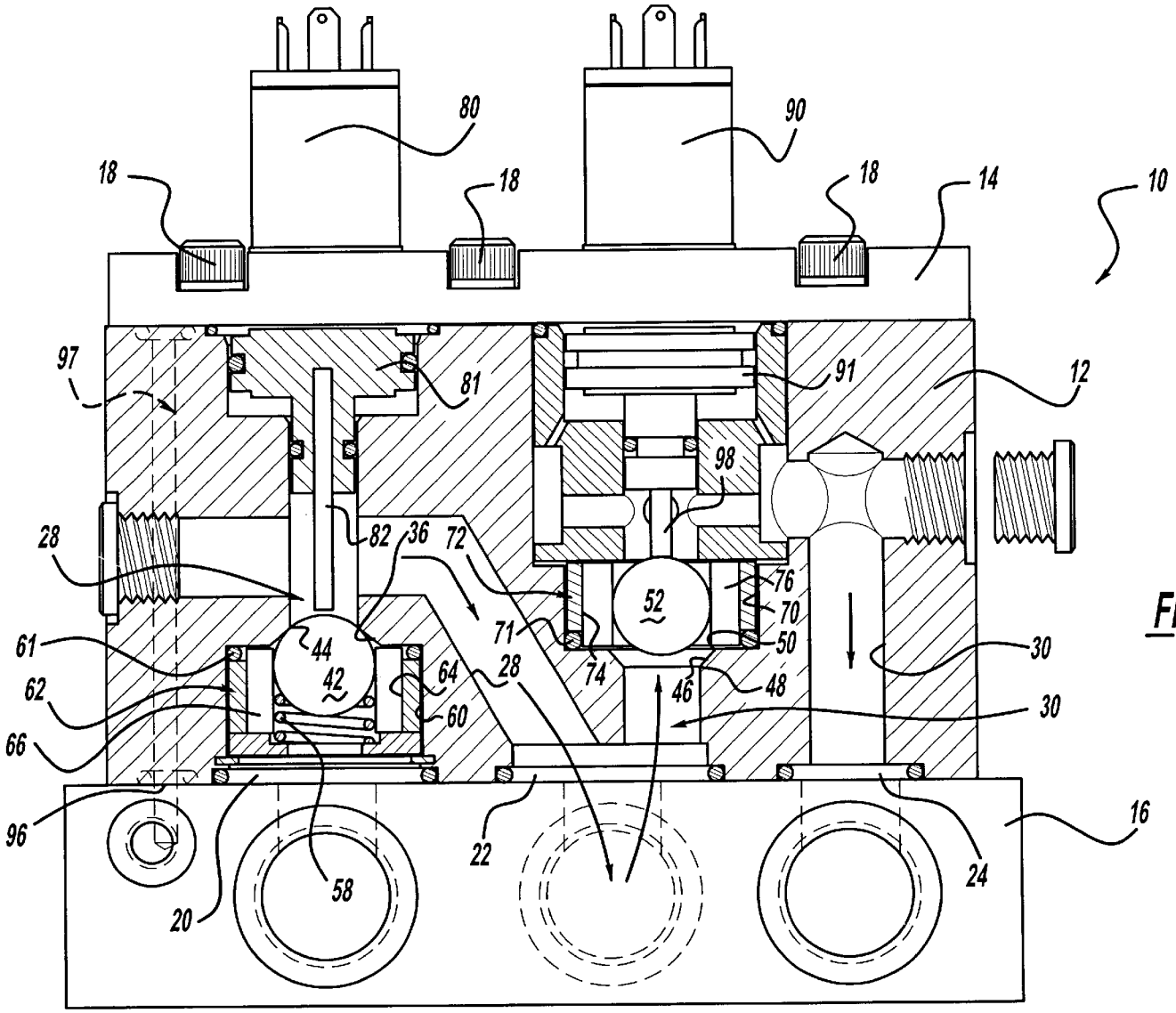
FIG. 1 is a cross-sectional illustration of an exemplary fluid control valve according to the present invention.
Figure 2:
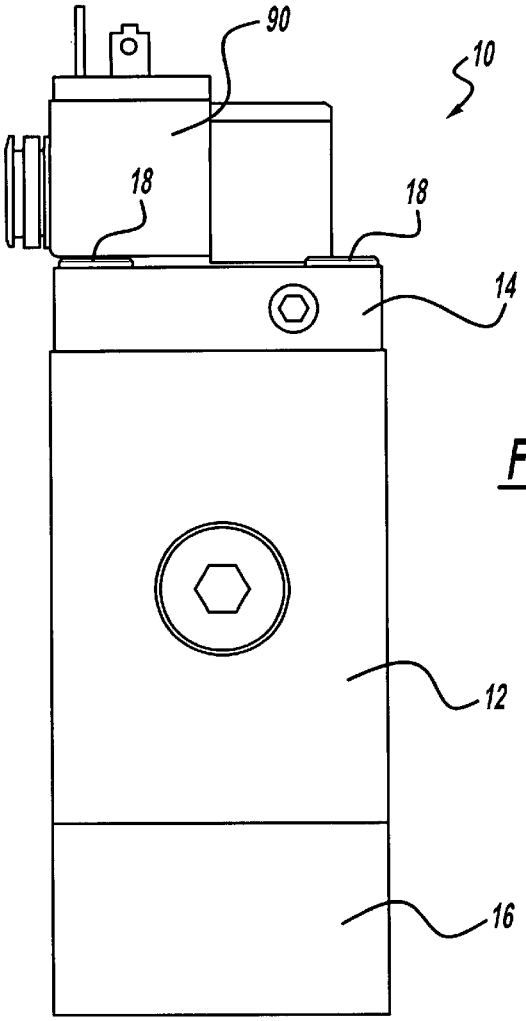
FIG. 2 is an end view of the fluid control valve of FIG. 1.
Figure 3:
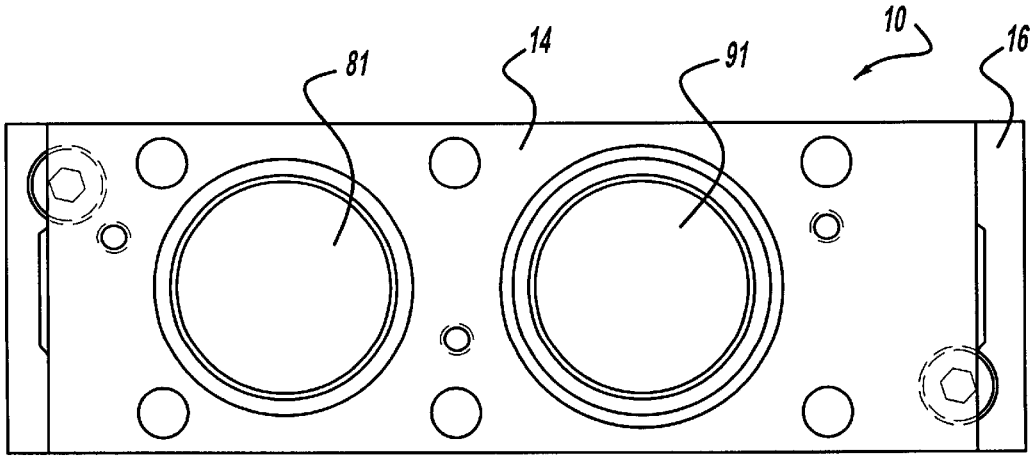
FIG. 3 is a top view of the fluid control valve of FIGS. 1 and 2, with the top cover or cap removed.

In FIG. 1, the fluid control valve 10 includes a body 12, a pilot cap 14, both of which can be secured to a manifold 16 by way of a number of bolts 18, as well as being capable of alternate interconnection by way of fluid piping without the use of the manifold 16.

The exemplary control valve 10 includes an inlet port 20, an outlet or load port 22, and an exhaust port 24. A working fluid supply passageway 28 provides working fluid communication from the inlet port 20 to the outlet port 22, which is connected, such as by way of the manifold 16, to a fluid-actuated device. Similarly, an exhaust passageway 30 provides exhaust fluid communication between the load port 22 and the exhaust outlet 24.

In the exemplary control valve 10, the supply and exhaust passageways 28 and 30 respectively include a frusto-conical supply valve seat 36 and a frusto-conical exhaust valve seat 46. The supply valve seat 36 includes a smaller-diameter end 38 and a larger-diameter end 40. Similarly the exhaust valve seat 46 includes a smaller-diameter end 48 and a larger-diameter end 50. A generally spherical supply ball-poppet 42 and a similar generally spherical exhaust ball-poppet 52 are provided for opening and closing movement with respect to their respective frusto-conical supply and exhaust valve seats 36 and 46.

The supply ball-poppet 42 is preferably movably actuated by way of a supply pilot actuator 80, which receives pilot air from a pilot air passageway 97, which is in turn connected in fluid communication with a pilot air inlet 96. When the supply pilot actuator 80 is energized, it transmits the force of the pilot air on the supply piston 81, by way of a supply push rod 82, to urge the supply ball-poppet 42 away from the supply valve seat 36, thus opening the supply valving portion of the control valve 10. When the supply pilot actuator 80 is deenergized, the ball-poppet 42 is returned to its closed position under the influence of the inlet fluid pressure and a return spring 58.

Similarly, the exhaust ball-poppet 52 is urged into its closed position with respect to the exhaust valve seat 46 by way of the energization of an exhaust pilot actuator 90, which acts to exert the force of pilot air on an exhaust piston 91, by way of an exhaust push rod 92, to the exhaust ball-poppet 52. Upon deenergization of the exhaust pilot actuator 90, the exhaust ball-poppet 52 is urged back to its open position under the influence of high-pressure working fluid in the exhaust passageway 30.

One skilled in the control valve art will readily recognize that actuators other than the exemplary electro-pneumatic supply pilot actuator 80 and electro-pneumatic exhaust pilot actuator 90, can alternatively be employed. Such actuating devices could include electro-mechanical solenoids, either local or remote, mechanical motion transmitting devices, or a wide variety of other actuating devices well-known to those skilled in the art.

Figure 4:
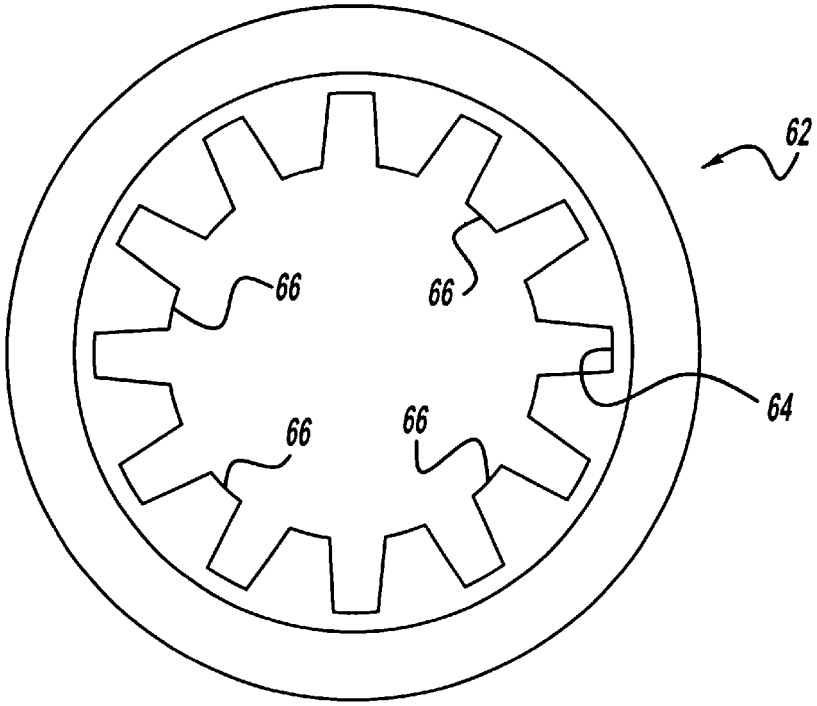
FIG. 4 is a top view of a ball-poppet guide for use with either or both of a supply ball-poppet and an exhaust ball-poppet of the control valve of FIG. 1.
Figure 5:
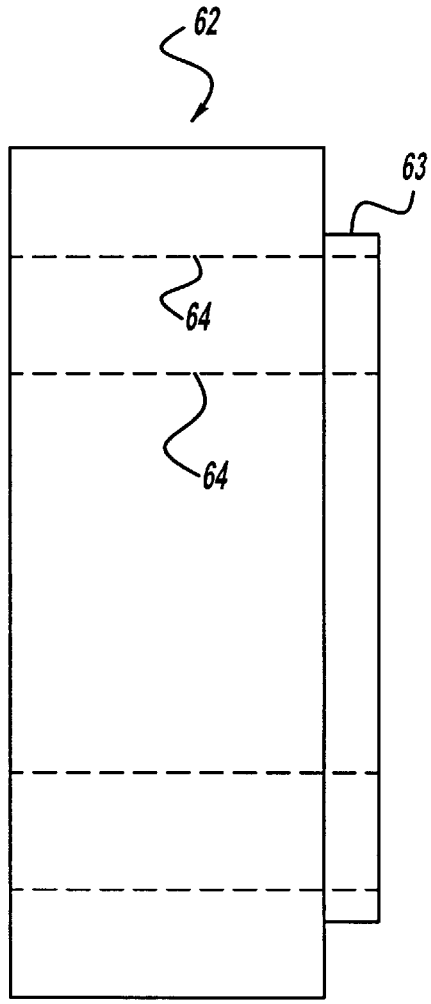
FIG. 5 is a side view of the poppet guide of FIG. 4.
Figure 6:
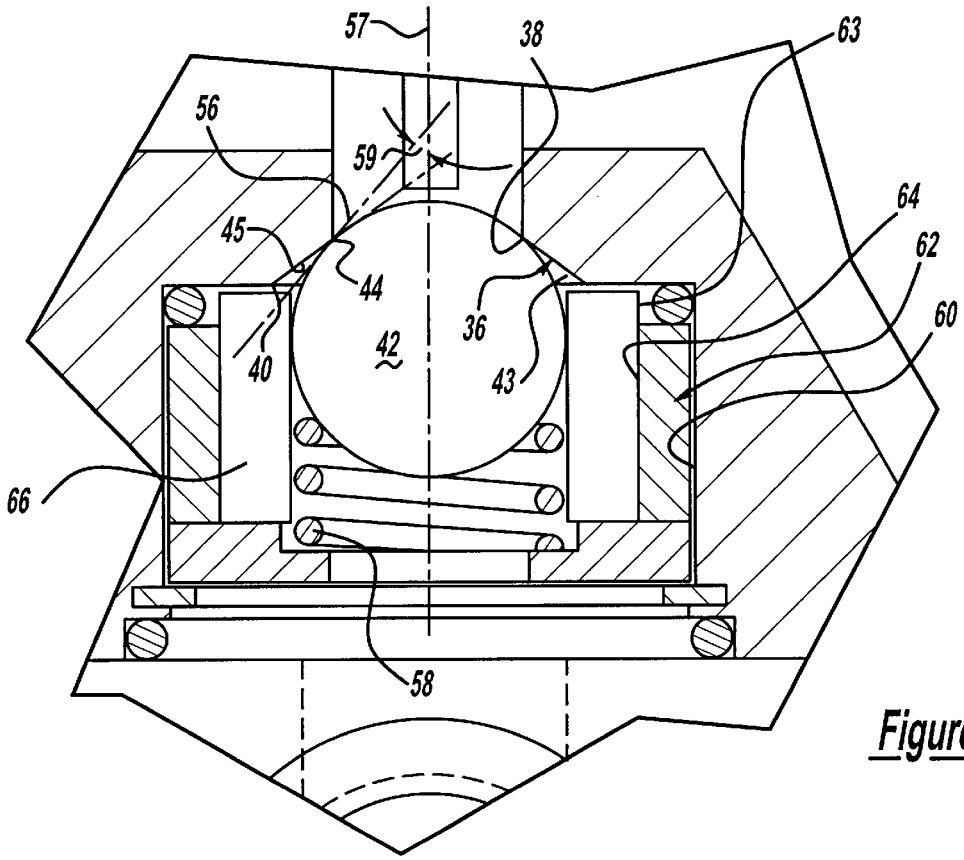
FIG. 6 is an enlarged detail view of the supply valving portion of the control valve of FIG. 1, with the supply ball-poppet shown in its closed position.
Figure 7:
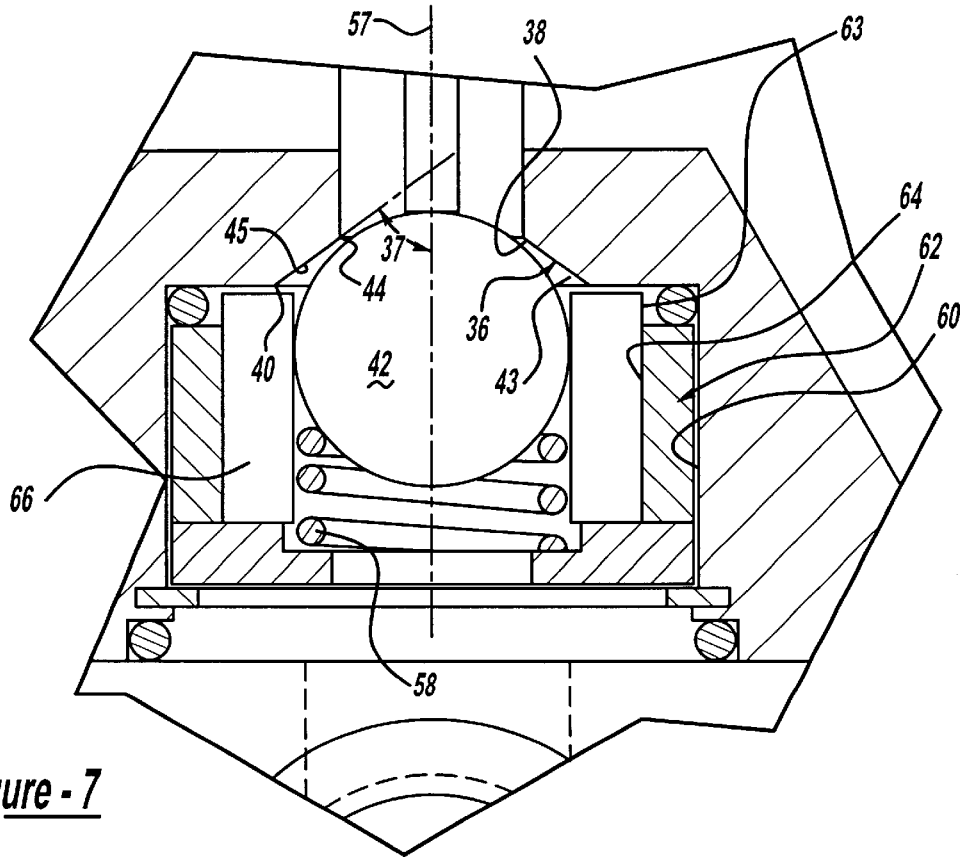
FIG. 7 is an enlarged detailed view similar to that of FIG. 6, but illustrating the supply ball-poppet in its initially opening position.

Referring primarily to FIGS. 6 and 7, the exemplary high-pressure fluid control valve 10 depicted in the drawings also preferably includes a generally cylindrical supply cavity 60 immediately upstream of the larger-diameter upstream end 40 of the supply valve seat 36. As illustrated in FIGS. 4 through 6, a generally cylindrical supply poppet guide 62 is provided upstream within the preferred diametrically-enlarged cylindrical supply cavity 60. The supply poppet guide 62 includes a generally cylindrical central supply guide bore 64 extending axially therethrough, with a number of circumferentially spaced-apart and axially-extending supply guide fins 66 protruding radially inwardly into the supply guide bore 64. The supply ball-poppet 42 is received within the supply guide bore 64 for axial movement within the radially inward edges of the supply guide fins 66 between its open and closed positions with respect to the supply valve seat 36. As is perhaps best illustrated in FIGS. 6 and 7, the inner diameter of the supply cavity 60 is slightly greater than the outer diameter of the supply ball-poppet guide 62, thus allowing the poppet guide 62 and the ball-poppet 42 to float radially within the supply cavity 60, which in turn allows the generally spherical supply ball-poppet 42 to be self-centering for sealing substantially line-contact 44 with the smaller-diameter end 38 of the supply valve seat 36.

In addition, the supply guide fins 66 preferably extend axially downstream to form a supply guide fin extension portion 63 on one end of the supply poppet guide 62. A resilient ring 61, such as an O-ring, surrounds the extension portion 63 in order to resiliently urge the poppet guide 62 toward the opposite, upstream end of the supply cavity 60, which is due to the resilient ring 61 being compressed between the floor of the supply cavity 60 and the remainder of the supply ball-poppet guide 62.

It should be noted that the above arrangement, as depicted in FIGS. 4 through 7, is substantially typical with respect to the frusto-conical exhaust valve seat 46, with its smaller-diameter upstream end 48 and its larger-diameter downstream end 50 for engagement in substantial line-contact of the smaller-diameter end 48 by the generally spherical exhaust poppet 52, all of which are shown in FIG. 1. Similarly, the supply poppet guide 62 depicted in FIGS. 4 and 5 is substantially typical for the exhaust poppet guide 72, which is received within the diametrically-enlarged generally cylindrical exhaust cavity 70 and has a similar central exhaust guide bore 74 and similar exhaust guide fins 76, and which can also be seen in FIGS. 1, 8 and 9.

Referring in particular to FIGS. 6 and 7, which depict an enlarged detail view of the supply valving portion of the exemplary control valve 10, the ball-poppet 42 is shown in its closed position in FIG. 6. In this position, the ball-poppet 42 is sealingly engaged in substantial line-contact 44 with the edge of the smaller-diameter end 38 of the supply valve seat 36. Similarly, the ball-poppet 42 is shown partially opened and thus moved out of such substantial line-contact 44 in FIG. 7. The frusto-conical supply valve seat 36 preferably has a valve seat angle 37 (with respect to the centerline 57 of the valve seat 36) that is slightly larger than the tangent angle 59 of the tangent line 56 to the ball-poppet 42 (with respect to the centerline 57) when the ball-poppet 42 is in the substantial line-contact 44 shown in FIG. 6.

This arrangement results in an annular space 43 creating a restricted supply flow area just upstream of the supply line-contact 44 and the smaller-diameter end 38 as the supply ball-poppet 42 initially moves out of such line-contact 44 to its open position shown in FIG. 7 as working fluid initially flows downstream past the ball-poppet 42 through the smaller-diameter end 38 of the supply valve seat 36. This results in any sonic flow erosion damage caused by such initial flow of high-pressure working fluid to be shifted substantially immediately to an upstream area 45 of the supply valve seat 36. This is highly advantageous in that it shifts such wear or damage caused by such sonic flow erosion to an area of the supply valve seat 36 that is adjacent the annular space 43 and that is never in sealing contact with the ball-poppet 42. This substantially minimizes sonic damage to the smaller-diameter downstream sealing end 38 of the supply valve seat 36 which is the only valve seat area that is ever in substantial line-contact 44 with the ball-poppet 42. As a result, the damage to and wear of the actual sealing surface of the valve seat 36 on the ball-poppet 42 is very substantially minimized and the functional life of the exemplary control valve 10 is correspondingly greatly extended. This in turn very significantly reduces the downtime and the maintenance costs for a system employing a control valve 10 according to the present invention.

As will be readily recognized by one skilled in the art, that the above-described function of the ball-poppet 42 with respect to the supply valve seat 36 as shown in FIG. 6 and FIG. 7 is similar to that of the function and relationship of the exhaust ball-poppet 52 with respect to the exhaust valve seat 46 with its smaller-diameter end 48 and its larger-diameter end 50.

Figure 8:
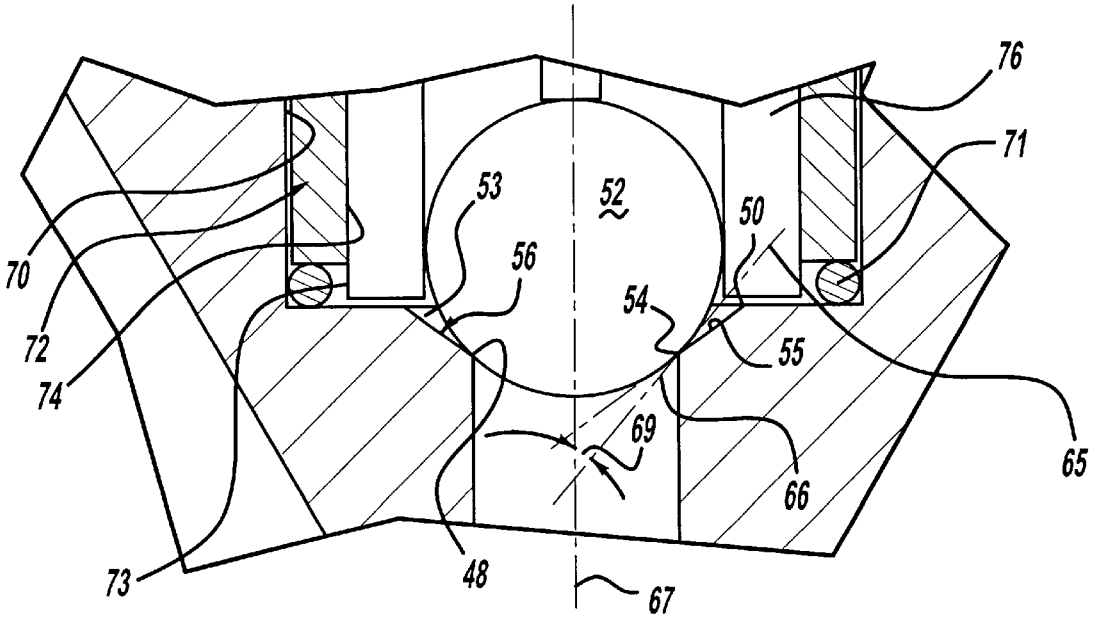
FIG. 8 is an enlarged detail view of the exhaust valving portion of the control valve of FIG. 1, with the exhaust ball-poppet shown in its closed position.
Figure 9:
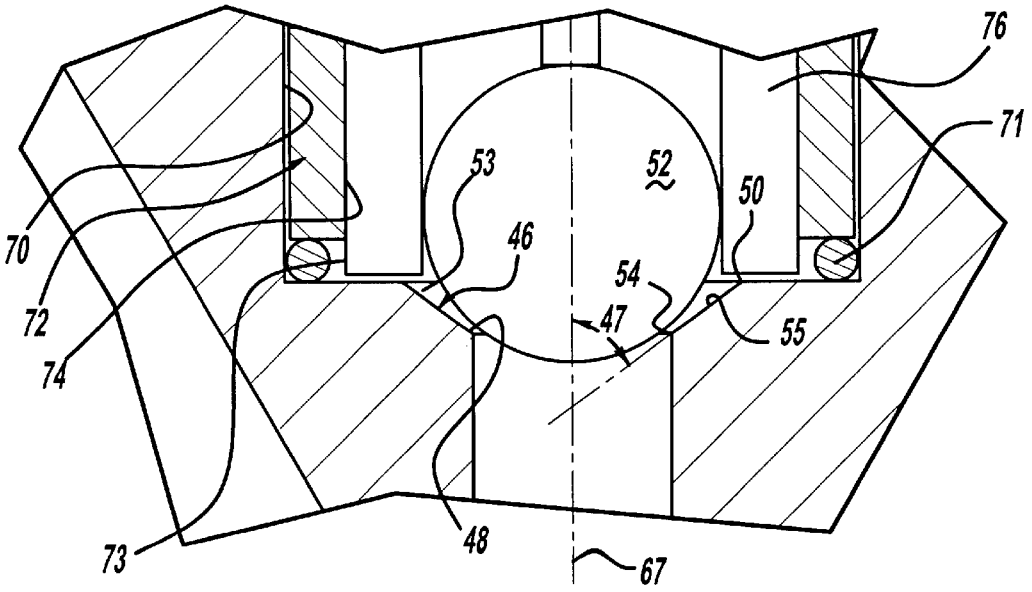
FIG. 9 is an enlarged detail view similar to that of FIG. 8, but illustrating the exhaust ball-poppet in it initially opening position.

Referring primarily to FIGS. 8 and 9, the exemplary high-pressure fluid control valve 10 depicted in the drawings also preferably includes a generally cylindrical exhaust cavity 70 immediately downstream of the larger-diameter downstream end 50 of the exhaust valve seat 46. A generally cylindrical exhaust poppet guide 72 (similar to that of the supply poppet guide 62 of FIGS. 5 and 6) is provided downstream within the preferred diametrically-enlarged cylindrical exhaust cavity 70. The exhaust poppet guide 72 includes a generally cylindrical central exhaust guide bore 74 extending axially therethrough, with a number of circumferentially spaced-apart and axially-extending exhaust guide fins 76 protruding radially inwardly into the exhaust guide bore 74. The exhaust ball-poppet 52 is received within the exhaust guide bore 74 for axial movement within the radially inward edges of the exhaust guide fins 76 between its open and closed positions with respect to the exhaust valve seat 46. The inner diameter of the exhaust cavity 70 is slightly greater than the outer diameter of the exhaust ball-poppet guide 72, thus allowing the poppet guide 72 and the exhaust ball-poppet 52 to float radially within the exhaust cavity 70, which in turn allows the generally spherical exhaust ball-poppet 52 to be self-centering for sealing substantially line-contact 54 with the smaller-diameter end 48 of the exhaust valve seat 46.

The exhaust guide fins 76 preferably extend axially upstream to form an exhaust guide fin extension portion 73 on the exhaust poppet guide 72. A resilient ring 71, such as an O-ring, surrounds the extension portion 73 in order to urge the poppet guide 72 toward the opposite, downstream end of the exhaust cavity 70, which is due to the resilient ring 71 being compressed between the floor of the exhaust cavity 70 and the remainder of the exhaust ball-poppet guide 72.

Referring in particular to FIGS. 8 and 9, which depict an enlarged detail view of the exhaust valving portion of the exemplary control valve 10, the exhaust ball-poppet 52 is shown in its closed position in FIG. 8. In this position, the ball-poppet 52 is sealingly engaged in substantial line-contact 54 with the edge of the smaller-diameter end 48 of the exhaust valve seat 46. Similarly, the ball-poppet 52 is shown partially opened and thus moved out of such substantial line-contact 54 in FIG. 9. The frusto-conical exhaust valve seat 46 preferably has an exhaust valve seat angle 47 (with respect to the exhaust centerline 67 of the valve seat 46) that is slightly larger than the exhaust tangent angle 69 of the exhaust tangent line 65 to the exhaust ball-poppet 52 (with respect to the centerline 67) when the ball-poppet 52 is in the substantial line-contact 54 shown in FIG. 8.

This arrangement results in an annular space 53 creating a restricted exhaust flow area just downstream of the exhaust line-contact 54 and the smaller-diameter end 48 as the exhaust ball-poppet 52 initially moves out of such line-contact 54 to its open position shown in FIG. 9 as exhaust fluid initially flows downstream past the ball-poppet 52 through the smaller-diameter end 48 of the exhaust valve seat 46. This results in any sonic flow erosion damage caused by such initial flow of high-pressure exhaust fluid to be shifted substantially immediately to an upstream area adjacent the exhaust valve seat 46. This is highly advantageous in that it shifts such wear or damage caused by such sonic flow erosion to an area that is never in sealing contact with the ball-poppet 52. This substantially minimizes sonic damage to the smaller-diameter sealing end 48 of the exhaust valve seat 46 which is the only valve seat area that is ever in substantial line-contact 54 with the ball-poppet 52. As a result, the damage to and wear of the actual sealing surface of the valve seat 46 on the ball-poppet 52 is very substantially minimized and the functional life of the exemplary control valve 10 is correspondingly greatly extended. This in turn very significantly reduces the downtime and the maintenance costs for a system employing a control valve 10 according to the present invention.

Referring primarily to FIG. 1, the cross-over leakage of the exemplary fluid control valve 10 depicted in the drawings is substantially minimized by energizing the exhaust pilot actuator 90 to close the exhaust ball-poppet 52 just slightly prior to energizing the supply pilot actuator 80 to open the ball-poppet 42 when high-pressure working fluid is to be admitted to the outlet or load port 22 in order to actuate a fluid-actuated device. Because of the equipment and energy necessary to elevate the working fluid to such a high-pressure state, this greatly reduces the operating costs that would otherwise result from excessive waste or exhaust of high-pressure working fluid. Such high-pressure working fluid, which can be either pneumatic or hydraulic, but which is preferably pneumatic, is often in the range of 300 psig to 900 psig, and is typically approximately 600 psig in the above-mentioned blow-molding processes.

Finally, either or both of the ball-poppets 42 and 52 are preferably composed of a metallic material, such as stainless steel or other metallic or non-metallic materials deemed advantageous by one skilled in the art for a given application. Similarly, either or both of the supply poppet guide 62 and the exhaust poppet guide 72 are preferably composed of a synthetic material, such as nylon, but can also be composed of a metallic material, such a stainless steel, or other suitable materials known to those skilled in the art.

The foregoing discussion discloses and describes merely exemplary embodiments of the present invention for purposes of illustration only. One skilled in the art will readily recognize from such discussion, and from the accompanying drawings and claims, that various changes, modifications, and variations can be made therein without departing from the spirit and scope of the invention as defined in the following claims.

What is claimed is:

1. A control valve for operating a fluid-actuated device, said control valve having an inlet in fluid communication with a source of pressurized working fluid, a load outlet in fluid communication with said fluid-actuated device, a fluid supply passageway providing fluid communication for said working fluid from said inlet to said outlet, said control valve further including a generally frusto-conical supply valve seat located in said fluid supply passageway, said supply valve seat having a smaller-diameter downstream end and a larger-diameter upstream end, and a generally spherical supply poppet being selectively movable between respective supply closed and supply open positions into and out of substantially supply poppet line-contact for sealing with said smaller-diameter end of said supply valve seat, said generally spherical supply poppet having a chord dimension at said line-contact with said smaller-diameter downstream end of said supply valve seat that is smaller than said larger-diameter upstream end of said supply valve seat, said generally frusto-conical supply valve seat having a supply seat angle relative to the centerline of said supply valve seat that is greater than an angle formed by the centerline of said supply valve seat and a line tangent to said spherical supply poppet at said supply poppet line-contact when said supply poppet is in said closed position, an annular space formed between said supply valve seat and said spherical supply poppet defining a restricted supply flow area upstream of said supply poppet line-contact between said spherical supply poppet and said smaller-diameter downstream end of said supply valve seat as said spherical supply poppet initially moves out of said line-contact to said supply open position and as said working fluid initially flows downstream past said supply poppet through said smaller-diameter end of said supply valve seat, any sonic flow erosion caused by said initial working fluid flow thereby being shifted substantially immediately to an upstream area of said supply valve seat that is adjacent said restricted supply flow area and that is not sealingly contacted by said spherical supply poppet thus substantially minimizing sonic damage to said smaller-diameter downstream end of said supply valve seat.

2. A control valve according to claim 1, wherein said fluid supply passageway includes a generally cylindrical supply cavity immediately upstream of said larger-diameter upstream end of said supply valve seat, said supply cavity being larger in diameter than said larger-diameter upstream end, said control valve further including a generally cylindrical supply poppet guide located in said supply cavity of said fluid supply passageway, said supply poppet guide having a central supply guide bore extending axially therethrough, said supply poppet guide having a number of circumferentially spaced-apart axially-extending supply guide fins protruding radially inwardly into said supply guide bore, said supply poppet being received within said supply guide bore for axial movement within radially inward edges of said supply guide fins between said supply open position and said supply closed positions the inner diameter of said supply cavity being greater than the outer diameter of said supply poppet guide in order to allow said supply poppet guide to float radially within said supply cavity and to allow said spherical supply poppet to be substantially self-centering for sealing line-contact with said smaller-diameter end of said frusto-conical supply valve seat.

3. A control valve according to claim 2, wherein the axial lengths of said supply guide fins are greater than the axial length of the remainder of said supply poppet guide and protrude axially therefrom in a downstream direction toward said supply valve seat to form a supply guide fin extension portion of said supply poppet guide, said control valve including a resilient ring surrounding said supply guide fin extension portion in order to resiliently urge said supply poppet guide in an axially upstream direction within said supply cavity portion.

4. A control valve according to claim 1, further including an exhaust outlet, a fluid exhaust passageway in fluid communication for exhaust fluid between said load outlet and said exhaust outlet, a generally frusto-conical exhaust valve seat located in said fluid exhaust passageway, said exhaust valve seat having a smaller-diameter end and a larger-diameter end, and a generally spherical exhaust poppet being selectively movable between respective exhaust closed and exhaust open positions into and out of substantially exhaust poppet line-contact for sealing with said smaller-diameter end of said exhaust valve seat, said generally spherical exhaust poppet having a chord dimension at said line-contact with said smaller-diameter end that is smaller than said larger-diameter end of said exhaust valve seat, said generally frusto-conical exhaust valve seat having an exhaust seat angle relative to the centerline of said exhaust valve seat that is greater than an angle formed by the centerline of said exhaust valve seat and a line tangent to said spherical exhaust poppet at said exhaust poppet line-contact when said exhaust poppet is in said closed position, an annular space formed between said exhaust valve seat and said spherical exhaust poppet defining a restricted exhaust flow area adjacent said exhaust poppet line-contact between said spherical exhaust poppet and said smaller-diameter end of said exhaust valve seat as said spherical exhaust poppet initially moves out of said line-contact to said exhaust open position and as said exhaust fluid initially flows past said exhaust poppet and through said smaller-diameter end of said exhaust valve seat, any sonic flow erosion caused by said initial exhaust flow thereby being shifted substantially immediately to a flow area that is adjacent said ball-poppet line contact and that is not sealingly contacted by said spherical exhaust poppet thus substantially minimizing sonic damage to said smaller-diameter end of said exhaust valve seat.

5. A control valve according to claim 4 wherein said fluid exhaust passageway includes a generally cylindrical exhaust cavity immediately downstream of said larger-diameter end of said exhaust valve seat, said exhaust cavity being larger in diameter than said larger-diameter end, said control valve further including a generally cylindrical exhaust poppet guide located in said exhaust cavity of said fluid exhaust passageway, said exhaust poppet guide having a central exhaust guide bore extending axially therethrough, said exhaust poppet guide having a number of circumferentially spaced-apart axially-extending exhaust guide fins protruding radially inwardly into said exhaust guide bore, said exhaust poppet being received within said exhaust guide bore for axial movement within radially inward edges of said exhaust guide fins between said exhaust open position and said exhaust closed positions, the inner diameter of said exhaust cavity being greater than the outer diameter of said exhaust poppet guide in order to allow said exhaust poppet guide to float radially within said exhaust cavity and to allow said spherical exhaust poppet to be substantially self-centering for sealing line-contact with said smaller-diameter end of said frusto-conical exhaust valve seat.

6. A control valve according to claim 4, further including a supply pilot actuator and an exhaust pilot actuator, said supply pilot actuator being selectively energizable to move said supply poppet away from said supply valve seat to said supply open position, said exhaust pilot actuator being selectively energizable to move said exhaust poppet toward said exhaust valve seat to said exhaust closed position, said exhaust pilot actuator being energized prior to said supply pilot actuator in order to substantially negate internal cross-over leakage when said working fluid is to be admitted to said outlet.

7. A control valve according to claim 4, wherein said supply poppet and said exhaust poppet are composed of a metallic material.

8. A control valve according to claim 7, wherein said metallic material includes stainless steel.

9. A control valve according to claim 4, wherein said supply poppet and said exhaust poppet are composed of a synthetic material.

10. A control valve according to claim 4, wherein said supply poppet is composed of a metallic material.

11. A control valve according to claim 10, wherein said metallic material includes stainless steel.

12. A control valve according to claim 4, wherein said exhaust poppet is composed of a metallic material.

13. A control valve according to claim 12, wherein said metallic material includes stainless steel.

14. A control valve according to claim 1, wherein said working fluid is a pressurized pneumatic working fluid.

15. A control valve according to claim 14, wherein said pneumatic working fluid is at a pressure in the range of 300 psig to 900 psig.

16. A control valve according to claim 15, wherein said pneumatic working fluid is at a pressure of approximately 600 psig.

17. A control valve according to claim 1, wherein said working fluid is a pressurized liquid working fluid.

18. A control valve according to claim 1, wherein said supply poppet is composed of a metallic material.

19. A control valve according to claim 18, wherein said metallic material includes stainless steel.

20. A control valve according to claim 1, wherein said supply poppet is composed of a synthetic material.

21. A control valve for operating a fluid-actuated device, said control valve having an inlet in fluid communication with a source of pressurized working fluid, a load outlet in fluid communication with said fluid-actuated device, said control valve further including a valve seat and a generally spherical poppet being selectively movable between respective closed and open positions into and out of substantially line-contact for sealing with said valve seat, said control valve further including a generally cylindrical cavity immediately adjacent said valve seat and a generally cylindrical poppet guide located in said cavity, said poppet guide having a central guide bore extending axially therethrough and a number of circumferentially spaced-apart axially-extending guide fins protruding radially inwardly into said guide bore, said poppet being received within said guide bore for axial movement within radially inward edges of said guide fins between said open position and said closed positions, the inner diameter of said cavity being greater than the outer diameter of said poppet guide in order to allow said poppet guide to float radially within said cavity and to allow said spherical poppet to be substantially self-centering for sealing line-contact with said valve seat.

22. A control valve according to claim 21, wherein the axial lengths of said guide fins are greater than the axial length of the remainder of said poppet guide and protrude axially therefrom in a direction toward said valve seat to form a guide fin extension portion of said poppet guide, said control valve including a resilient ring surrounding said guide fin extension portion in order to resiliently urge said poppet guide in an axial direction away from said valve seat.

23. A control valve according to claim 21, wherein said poppet guide is composed of a synthetic material.

24. A control valve according to claim 23, wherein said synthetic material includes nylon.

25. A control valve according to claim 21, wherein said poppet guide is composed of a metallic material.

26. A control valve according to claim 25, wherein said metallic material includes stainless steel.

27. A control valve for operating a fluid-actuated device, said control valve having an inlet in fluid communication with a source of pressurized working fluid, a load outlet in fluid communication with said fluid-actuated device, a fluid supply passageway providing fluid communication for said working fluid from said inlet to said outlet, said control valve further including a supply valve seat located in said fluid supply passageway said supply valve seat having a smaller-diameter downstream end and larger-diameter upstream end, and a generally spherical supply poppet being selectively movable between respective supply closed and supply open positions into and out of sealing contact with said supply valve seat, an annular space formed between said supply valve seat and said spherical supply poppet defining a restricted supply flow area upstream of said sealing contact between said spherical supply poppet and said smaller-diameter downstream end of said supply valve seat as said spherical supply poppet initially moves out of said sealing contact with said supply open position and as said working fluid initially flows downstream past said supply poppet through said smaller-diameter end of said supply valve seat, any sonic flow erosion caused by said initial working fluid flow thereby being shifted substantially immediately to an upstream area of said supply valve seat that is adjacent said restricted supply flow area and that is not sealingly contacted by said spherical supply poppet thus substantially minimizing sonic damage to said smaller-diameter downstream end of said supply valve seat, said control valve further including an exhaust outlet, a fluid exhaust passageway in fluid communication for exhaust fluid between said load outlet and said exhaust outlet, an exhaust valve seat located in said fluid exhaust passageway and a generally spherical exhaust poppet being selectively movable between respective exhaust closed and exhaust open positions into and out of sealing contact with said valve seat, said control valve further including a supply pilot actuator and an exhaust pilot actuator, said supply pilot actuator being selectively energizable to move said supply poppet away from said supply valve seat to said supply open position, said exhaust pilot actuator being selectively energizable to move said exhaust poppet toward said exhaust valve seat to said exhaust closed position, said exhaust pilot actuator being energized prior to said supply pilot actuator in order to substantially negate internal cross-over leakage when said working fluid is to be admitted to said outlet, said fluid supply passageway further including a generally cylindrical supply cavity immediately upstream of said larger-diameter upstream end of said supply valve seat, said control valve further including a generally cylindrical supply poppet guide located in said supply cavity of said fluid supply passageway, the inner diameter of said supply cavity being greater than the outer diameter of said supply poppet guide in order to allow said supply poppet guide to float radially within said supply cavity and to allow said spherical supply poppet to be substantially self-centering for sealing with said smaller-diameter end of said frusto-conical supply valve seat.

28. A control valve according to claim 27, wherein said working fluid is a pressurized pneumatic working fluid.

29. A control valve according to claim 28, wherein said pneumatic working fluid is at a pressure in the range of 300 psig to 900 psig.

30. A control valve according to claim 29, wherein said pneumatic working fluid is at a pressure of approximately 600 psig.

31. A control valve according to claim 27, wherein said working fluid is a pressurized liquid working fluid.

32. A control valve according to claim 27, wherein said supply poppet is composed of a metallic material.

33. A control valve according to claim 32, wherein said metallic material includes stainless steel.

34. A control valve according to claim 27, wherein said supply poppet is composed of a synthetic material.

35. A control valve according to claim 27, wherein said supply poppet and said exhaust poppet are composed of a metallic material.

36. A control valve according to claim 35, wherein said metallic material includes stainless steel.

37. A control valve according to claim 27, wherein said supply poppet and said exhaust poppet are composed of a synthetic material.

38. A control valve according to claim 27, wherein said exhaust poppet is composed of a metallic material.

39. A control valve according to claim 38, wherein said metallic material includes stainless steel.

40. A control valve for operating a fluid-actuated device, said control valve having an inlet in fluid communication with a source of pressurized working fluid, a load outlet in fluid communication with said fluid-actuated device, a fluid supply passageway providing fluid communication for said working fluid from said inlet to said outlet, said control valve further including a generally frusto-conical supply valve seat located in said fluid supply passageway, said supply valve seat having a smaller-diameter downstream end and a larger-diameter upstream end, and a generally spherical supply poppet being selectively movable between respective supply closed and supply open positions into and out of substantially supply poppet line-contact for sealing with said smaller-diameter end of said supply valve seat, said generally spherical supply poppet having a chord dimension at said line-contact with said smaller-diameter downstream end of said supply valve seat that is smaller than said larger-diameter upstream end of said supply valve seat, said generally frusto-conical supply valve seat having a supply seat angle relative to the centerline of said supply valve seat that is greater than an angle formed by the centerline of said supply valve seat and a line tangent to said spherical supply poppet at said supply poppet line-contact when said supply poppet is in said closed position, an annular space formed between said supply valve seat and said spherical supply poppet defining a restricted supply flow area upstream of said supply poppet line-contact between said spherical supply poppet and said smaller-diameter downstream end of said supply valve seat as said spherical supply poppet initially moves out of said line-contact to said supply open position and as said working fluid initially flows downstream past said supply poppet through said smaller-diameter end of said supply valve seat, any sonic flow erosion caused by said initial working fluid flow thereby being shifted substantially immediately to an upstream area of said supply valve seat that is adjacent said restricted supply flow area and that is not sealingly contacted by said spherical supply poppet thus substantially minimizing sonic damage to said smaller-diameter downstream end of said supply valve seat, said control valve further including an exhaust outlet, a fluid exhaust passageway in fluid communication for exhaust fluid between said load outlet and said exhaust outlet, a generally frusto-conical exhaust valve seat located in said fluid exhaust passageway, said exhaust valve seat having a smaller-diameter end and a larger-diameter end, and a generally spherical exhaust poppet having a diameter greater than that of said smaller-diameter downstream end, and a generally spherical exhaust poppet being selectively movable between respective exhaust closed and exhaust open positions into and out of substantially exhaust poppet line-contact for sealing with said smaller-diameter end of said exhaust valve seat, said generally spherical exhaust poppet having a chord dimension at said line-contact with said smaller-diameter end that is smaller than said larger-diameter end of said exhaust valve seat, said generally frusto-conical exhaust valve seat having an exhaust seat angle relative to the centerline of said exhaust valve seat that is greater than an angle formed by the centerline of said exhaust valve seat and a line tangent to said spherical exhaust poppet at said exhaust poppet line-contact when said exhaust poppet is in said closed position, an annular space formed between said exhaust valve seat and said spherical exhaust poppet defining a restricted exhaust flow area adjacent said exhaust poppet line-contact between said spherical exhaust poppet and said smaller-diameter end of said exhaust valve seat as said spherical exhaust poppet initially moves out of said line-contact to said exhaust open position and as said exhaust fluid initially flows past said exhaust poppet and through said smaller-diameter end of said exhaust valve seat, any sonic flow cavitation caused by said initial exhaust flow thereby being shifted substantially immediately to a flow area that is adjacent said ball-poppet line contact and that is not sealingly contacted by said spherical exhaust poppet thus substantially minimizing sonic damage to said smaller-diameter end of said exhaust valve seat, said fluid supply passageway including a generally cylindrical supply cavity immediately upstream of said larger-diameter upstream end of said supply valve seat, said supply cavity being larger in diameter than said larger-diameter upstream end, said control valve futher including a generally cylindrical supply poppet guide located in said supply cavity of said fluid supply passageway, said supply poppet guide having a central supply guide bore extending axially therethrough, said supply poppet guide having a number of circumferentially spaced-apart axially-extending supply guide fins protruding radially inwardly into said supply guide bore, said supply poppet being received within said supply guide bore for axial movement within radially inward edges of said supply guide fins between said supply open position and said supply closed positions the inner diameter of said supply cavity being greater than the outer diameter of said supply poppet guide in order to allow said supply poppet guide to float radially within said supply cavity and to allow said spherical supply poppet to be substantially self-centering for sealing line-contact with said smaller-diameter end of said frusto-conical supply valve seat, said fluid exhaust passageway including a generally cylindrical exhaust cavity immediately downstream of said larger-diameter downstream end of said exhaust valve seat, said exhaust cavity being larger in diameter than said larger-diameter downstream end, said control valve futher including a generally cylindrical exhaust poppet guide located in said exhaust cavity of said fluid exhaust passageway, said exhaust poppet guide having a central exhaust guide bore extending axially therethrough, said exhaust poppet guide having a number of circumferentially spaced-apart axially-extending exhaust guide fins protruding radially inwardly into said exhaust guide bore, said exhaust poppet being received within said exhaust guide bore for axial movement within radially inward edges of said exhaust guide fins between said exhaust open position and said exhaust closed positions the inner diameter of said exhaust cavity being greater than the outer diameter of said exhaust poppet guide in order to allow said exhaust poppet guide in order to allow said exhaust poppet guide to float radially within said exhaust cavity and to allow said spherical exhaust poppet to be substantially self-centering for sealing line-contact with said smaller-diameter end of said frusto-conical exhaust valve seat, said control valve further including a supply pilot actuator and an exhaust pilot actuator, said supply pilot actuator being selectively energizable to move said supply poppet away from said supply valve seat to said supply open position, said exhaust pilot actuator being selectively energizable to move said exhaust poppet toward said exhaust valve seat to said exhaust closed position, said exhaust pilot actuator being energized prior to said supply pilot actuator in order to substantially negate cross-over leakage when said working fluid is to be admitted to said outlet.

41. A control valve according to claim 40, wherein the axial lengths of said supply guide fins are greater than the axial length of the remainder of said supply poppet guide and protrude axially therefrom in a downstream direction toward said supply valve seat to form a supply guide fin extension portion of said supply poppet guide, said control valve including a resilient ring surrounding said supply guide fin extension portion in order to resiliently urge said supply poppet guide in an axially upstream direction within said supply cavity portion.

42. A control valve according to claim 41, wherein the axial length of said exhaust guide fins are greater than the axial length of the remainder of said exhaust poppet guide and protrude axially therefrom in an upstream direction toward said exhaust valve seat to form an exhaust guide fin extension portion of said exhaust poppet guide, said control valve including a resilient ring surrounding said exhaust guide fin extension portion in order to resiliently urge said exhaust poppet guide in an axial downstream direction within said exhaust cavity portion.

43. A control valve according to claim 40, wherein said supply poppet is composed of a metallic material.

44. A control valve according to claim 43, wherein said metallic material includes stainless steel.

45. A control valve according to claim 40, wherein said supply poppet is composed of a synthetic material.

46. A control valve according to claim 40, wherein said supply poppet and said exhaust poppet are composed of a metallic material.

47. A control valve according to claim 46, wherein said metallic material includes stainless steel.

48. A control valve according to claim 40, wherein said supply poppet and said exhaust poppet are composed of a synthetic material.

49. A control valve according to claim 40, wherein said exhaust poppet is composed of a metallic material.

50. A control valve according to claim 49, wherein said metallic material includes stainless steel.

51. A control valve according to claim 40, wherein said working fluid is a pressurized pneumatic working fluid.

52. A control valve according to claim 40, wherein said pneumatic working fluid is at a pressure in the range of 300 psig to 900 psig.

53. A control valve according to claim 52, wherein said pneumatic working fluid is at a pressure of approximately 600 psig.

54. A control valve according to claim 40, wherein said working fluid is a pressurized liquid working fluid.

55. A control valve for operating a fluid-actuated device, said control valve having an inlet in fluid communication with a source of pressurized working fluid, a load outlet in fluid communication with said fluid-actuated device, a fluid supply passageway providing fluid communication for said working fluid from said inlet to said outlet, an exhaust outlet, a fluid exhaust passageway in fluid communication for exhaust fluid between said load outlet and said exhaust outlet, said control valve further including a generally frusto-conical exhaust valve seat located in said fluid exhaust passageway, said exhaust valve seat having a smaller-diameter end and a larger-diameter end, and a generally spherical exhaust poppet being selectively movable between respective exhaust closed and exhaust open positions into and out of substantially exhaust poppet line-contact for sealing with said smaller-diameter end of said exhaust valve seat, said generally spherical exhaust poppet having a chord dimension at said line-contact with said smaller-diameter end that is smaller than said larger-diameter end of said exhaust valve seat, said generally frusto-conical exhaust valve seat having an exhaust seat angle relative to the centerline of said exhaust valve seat that is greater than an angle formed by the centerline of said exhaust valve seat and a line tangent to said spherical exhaust poppet at said exhaust poppet line-contact when said exhaust poppet is in said closed position, an annular space formed between said exhaust valve seat and said spherical exhaust poppet defining a restricted exhaust flow area adjacent said exhaust poppet line-contact between said spherical exhaust poppet and said smaller-diameter end of said exhaust valve seat as said spherical exhaust poppet initially moves out of said line-contact to said exhaust open position and as said exhaust fluid initially flows past said exhaust poppet and through said smaller-diameter end of said exhaust valve seat, any sonic flow erosion caused by said initial exhaust flow thereby being shifted substantially immediately to a flow area that is adjacent said ball-poppet line contact and that is not sealingly contacted by said spherical exhaust poppet thus substantially minimizing sonic damage to said smaller-diameter end of said exhaust valve seat.

* * * * *